343-756 33 SR
4/1/86 XR 4,580,023

United States Patent [19]

Simpson

[11] Patent Number: 4,580,023

[45] Date of Patent: Apr. 1, 1986

[54] MICROWAVE OVEN WITH CIRCULAR POLARIZATION

[75] Inventor: James E. Simpson, Coralville, Iowa

[73] Assignee: Amana Refrigeration, Inc., Amana, Iowa

[21] Appl. No.: 709,237

[22] Filed: Mar. 6, 1985

[51] Int. Cl.[4] ..... H05B 6/72

[52] U.S. Cl. ..... 219/10.55 F; 219/10.55 R; 343/700 MS; 343/756

[58] Field of Search ..... 219/10.55 F, 10.55 R, 219/10.55 A; 343/700 MS, 731, 732, 741, 742, 756, 764, 869

[56] References Cited

U.S. PATENT DOCUMENTS

| | | | |
|---|---|---|---|
| 2,480,682 | 8/1949 | Stiefel | 219/10.55 R |
| 3,210,511 | 10/1965 | Smith | 219/10.55 F |
| 3,493,709 | 2/1970 | Lavoo et al. | 219/10.55 |
| 4,324,968 | 4/1982 | Smith | 219/10.55 F |
| 4,335,289 | 6/1982 | Smith | 219/10.55 F |
| 4,336,434 | 6/1982 | Miller | 219/10.55 F |
| 4,414,453 | 11/1983 | Simpson | 219/10.55 F |
| 4,496,814 | 1/1985 | Fitzmayer | 219/10.55 F |
| 4,508,946 | 4/1985 | Yoshimura et al. | 219/10.55 F |

*Primary Examiner*—Philip H. Leung

*Attorney, Agent, or Firm*—William R. Clark; Richard M. Sharkansky

[57] ABSTRACT

A circularly polarized microwave oven. Microwave energy is coupled from a waveguide above the ceiling to the cavity by a rotatable vertical probe. A strip transmission line closely spaced to the ceiling to limit radiation therefrom conducts the microwave current from the probe to a helical strip antenna radially offset from the axis of the probe. The helical strip antenna has a cylindrical segment which has a downward slope from its feed end to gradually increase the spacing between the cylindrical segment and the ceiling which functions as a ground plane. The increase in radiative efficiency around the cylindrical segment caused by increasing the spacing to the ceiling offsets the magnitude of the current traveling wave diminishing as a result of radiation losses. Accordingly, the magnitude of the X and Y electric vectors are substantially equal over a relatively wide angle thus defining circular polarization. Connected to the opposite end of the cylindrical segment is a flat or horizontal segment of the helical antenna. Rotation of the probe about its axis moves the helical antenna in a horizontal circular path thus further enhancing the heating uniformity.

20 Claims, 10 Drawing Figures

MICROWAVE OVEN WITH CIRCULAR POLARIZATION

BACKGROUND OF THE INVENTION

Since the introduction of microwave ovens, it has been recognized that the spatial distribution of the microwave energy in the cavity tends to be nonuniform. Because this nonuniformity may cause the undesirable condition of hot and cold spots within food being cooked, there has been extensive and continuous development work to improve the time averaged spatial distribution of energy. The spatial distribution is partially a function of reflections of microwave energy off of the conductive cavity walls thereby producing complex configurations of electromagnetic fields commonly referred to as modes. Simply stated, a major reason for the nonuniformity of the spatial distribution of microwave energy is the constructive and destructive interference of reflections. For example, where reflections add, a hot spot is created and where they subtract, a cold spot is created.

The principle approach for improving nonuniform heating in prior art microwave ovens has been to use a mode stirrer which attempts to randomize reflections and alter the modes by introducing a time varying scattering of the microwave energy. Typically, a mode stirrer is a metal paddle or propeller which rotates adjacent to the junction of the waveguide and the oven cavity. The object is to alter the modes so that the spatial positions of constructive and destructive interference move.

Another approach for improving uniformity has been to use a turntable within the microwave cavity to rotate the food and thereby move it through the hot and cold spots.

Another approach such as described in U.S. Pat. No. 4,414,453 utilizes a primary radiator that radiates microwave energy downward to the food in a directive pattern characteristic of antenna design. Rotation of the antenna sweeps the pattern over the food to improve the uniformity on a time average basis. Ideally, the rotation would result in concentric circles of uniform doneness. Radial evenness can be adjusted by changing the design of the pattern of the primary radiator. Further improvement is attained by increasing the diversity of the field patterns produced. One way of doing this has been to offset the radiating source from the center of rotation. Even though the original object of the primary radiator was to provide a somewhat directive pattern whereby a substantial portion of the microwave energy would be absorbed by the food before reflecting off the walls, a significant part of the radiation was still reflected before absorption. The reflections still interfered with the directly radiated wave within the food to increase or decrease the intensity depending on the difference of the phase of the interfering wave.

U.S. Pat. No. 4,336,434, issued June 22, 1982, states that a circularly polarized pattern provides more uniform spatial distribution of energy than linearly polarized. The explanation given therein is that this results because circularly polarized energy is reflected with a reversed direction of rotation. The circularly polarized energy is described as being provided by either using a waveguide that propagates circular polarization or using X slot apertures. Phase shifters are described between X slot apertures in order to provide beam steering for improving uniformity.

SUMMARY OF THE INVENTION

It is an object of this invention to provide an improved antenna for exciting waves in a microwave oven.

It is a further object that the waves excited be circularly polarized. Also, it is an object that the waves be in a pattern that moves in a circular horizontal path.

Further, it is an object that the waves be radiated from an antenna constructed from a single conductor that can be moved in a circular path offset from an axis of rotation.

Also, it is an object that the antenna be constructed from a single conductor wherein fabrication can be provided by punching from a metal sheet and formed by a few simple bends.

These and other objects are provided in accordance with the invention which defines a microwave oven comprising an oven cavity having a flat conductive surface, a helical antenna positioned in the cavity, the helical antenna having a first segment oblique to the flat conductive surface, the first segment having a feed end spaced less than one-eighth wavelength from the flat conductive surface and a second end spaced more than one-eighth wavelength from the surface, the helical antenna further comprising a second element connected to the second end of the first segment, the second segment being parallel with the flat conductive surface, and a source of microwave energy coupled to the feed end of the first segment. It is preferable that the helical antenna radiate microwave energy having substantially circular polarization over a large angle. Substantially circular polarization means that the X and Y electric field vectors are relatively equivalent or comparable in magnitude. For example, the weak axis linearly polarized component is preferably greater than 50% of the strong axis linearly polarized component over a radiation angle of 50°. It is preferable that the oven further comprise means for moving the helical antenna in a circular path parallel with the flat conductive surface. In one embodiment, the flat conductive surface may be the top of a truncated circular dome which is part of the ceiling and in which all or part of the helical antenna is positioned. Also, it may be preferable that the oven further comprise a waveguide positioned outside the cavity, a probe for coupling microwave energy from the waveguide into the cavity, and a strip transmission line perpendicularly connected to the probe and parallelly spaced less than one-eighth wavelength from the flat conductive surface. Also, it may be preferable that the moving means comprise means for rotating the probe about its axis.

The invention may also be practiced using a microwave oven comprising an oven cavity having a conductive ceiling comprising a horizontal surface, a helical strip antenna positioned in the cavity, the antenna having a cylindrical segment with a feed end spaced less than one-eighth wavelength from the surface of the ceiling and a second end spaced greater than one-eighth wavelength from the surface wherein the cylindrical segment is oblique to the surface, the antenna further comprising a flat segment connected to the second end of the cylindrical segment, the flat segment being parallel with the surface, and a source of microwave energy coupled to the feed end of the cylindrical segment for producing a traveling wave of microwave current on the antenna wherein the antenna radiates microwave energy having substantially circular polarization. The oven preferably further comprises means for moving the helical strip antenna in a horizontal circular path.

The invention further defines a microwave oven comprising a microwave cavity, a radiator of substantially circular polarized microwave radiation, the radiator being positioned in the cavity, a source of microwave energy coupled to the radiator, and means for moving the radiator in a circular path within the cavity. It is preferable that the radiator be a helical antenna comprising a cylindrical segment sloping from a feed end away from a wall of the cavity and a flat segment parallel with the wall connected to the opposite end of the cylindrical segment. In its classical definition, a cylindrical segment is a three-dimensional spiral and a flat segment is planar.

The invention may further be practiced by a microwave oven comprising an oven cavity having a ceiling comprising a flat horizontal surface such as the top of a truncated dome, a helical strip antenna positioned adjacent to the horizontal surface for providing a ground plane for the helical strip antenna, the helical strip antenna having at least one segment oblique to the horizontal surface sloping downward from a feed end spaced less than one-eighth wavelength from the horizontal surface, means for energizing the helical strip antenna to radiate microwave energy having substantially circular polarization, and means for moving the helical strip antenna in a circular horizontal path. It may be preferable that the feed end be spaced approximately 0.3 inches from the horizontal surface. Also, it may be preferable that the helical strip antenna further comprise a second segment parallel to the horizontal surface and connected to the end of the oblique segment opposite the feed end.

The invention further defines a microwave oven comprising a microwave cavity having sides, a ceiling comprising a flat horizontal surface, and a floor, a waveguide positioned above the ceiling, means for exciting the waveguide with microwave energy, an aperture in the waveguide communicating into the cavity, a vertical probe positioned in the aperture for coupling the microwave energy from the waveguide into the cavity, a horizontal strip conductor connected to the probe in the cavity for conducting the microwave energy, the conductor being spaced less than one-eighth wavelength from the flat horizontal surface of the ceiling whereby the surface functions as a ground plane of a microstrip transmission line to suppress radiation from the strip conductor, a helical strip antenna connected to one end of the strip conductor for radiating the microwave energy in the cavity with substantially circular polarization, the helical strip antenna having a flat segment spaced more than one-eighth wavelength from the horizontal surface of the ceiling and a sloped cylindrical segment interconnecting the strip conductor and the flat segment, and means for rotating the helical strip antenna about the axis of the probe. It is preferable that the cylindrical segment define an approximately 90° arc having a vertical drop of approximately seven-eighths of an inch. The rotating means may preferably comprise an air driven dielectric turbine connected to the antenna for rotating the helical strip antenna about the axis of the vertical probe. Also, the oven may comprise a strip connector extending in the opposite direction of the strip conductor past the probe to a perpendicularly attached strip used to secure the strip conductor to the turbine. Further, the strip conductor may have strip tabs for providing capacitive impedance matching.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
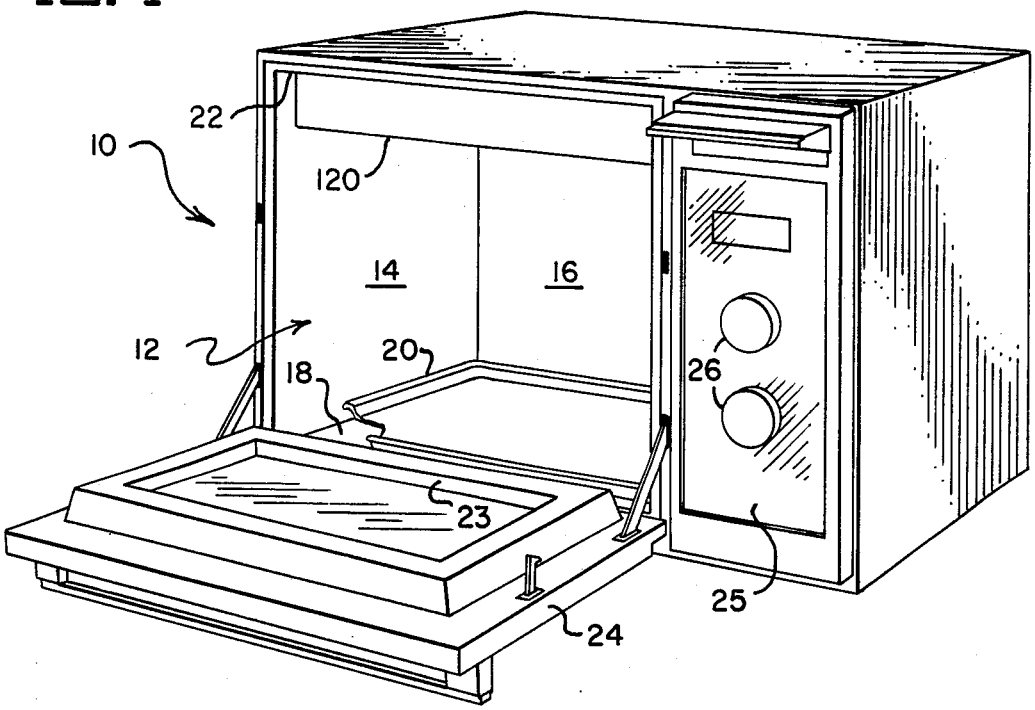
FIG. 1 is a front perspective view of a microwave oven.

Referring to FIG. 1, a front perspective view of a microwave oven 10 is shown. The cavity 12 of microwave oven 10 is generally defined by side walls 14, a back wall 16, a floor 18, which may be located below a microwave transparent platform such as tray 20, a ceiling 22 and a door 24 with a suitable microwave choke 23. Oven 10 has a control panel 25 with control knobs 26 which are used to activate and control a source of microwave energy such as magnetron 28 (FIG. 3) in conventional manner.

Figure 2:
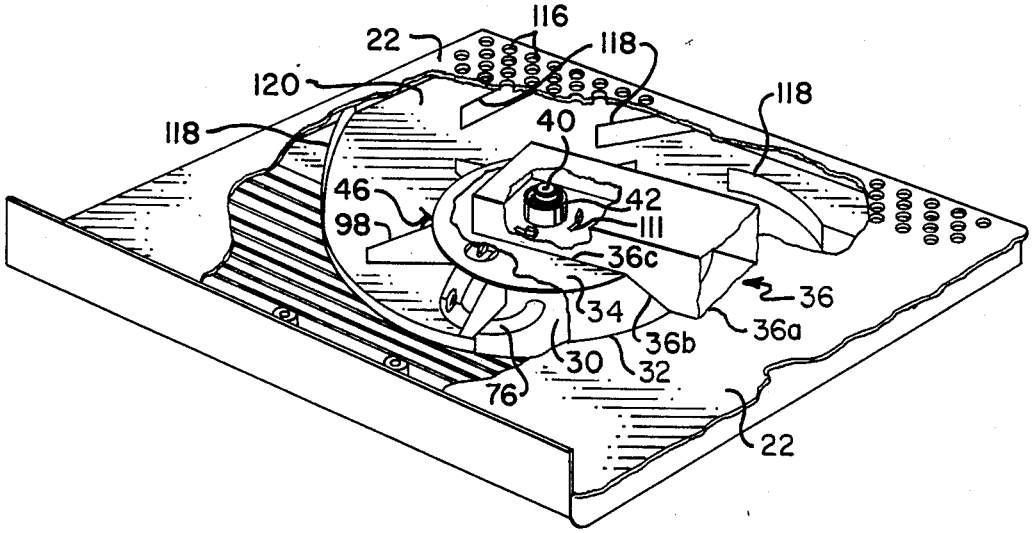
FIG. 2 is a partially cut-away perspective view of the ceiling and waveguide of the microwave oven.
Figure 3:
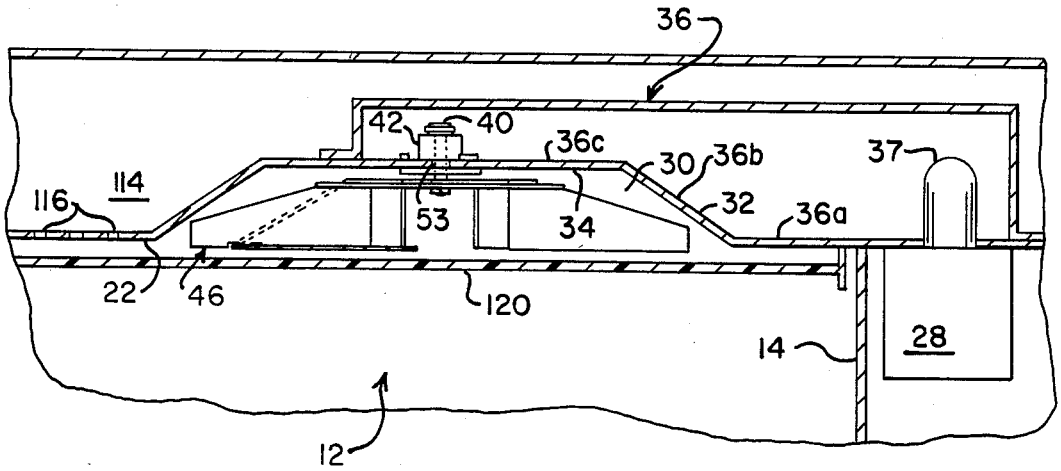
FIG. 3 is a sectioned elevation view of the ceiling along the waveguide.

Referring to FIGS. 2 and 3, perspective and front sectional views of ceiling 22 and waveguide 36 are shown. Ceiling 22 of cavity 12 has a recess 30 formed by a truncated conical dome 32 having a flat top 34. As an example, truncated conical dome 32 has a height of one inch with an entrance diameter of 11 inches, and flat top 34 has a diameter of 7 inches. A rectangular waveguide 36, which may share ceiling 22 as a common wall with cavity 12, is positioned above ceiling 22 and follows the contour of dome 32 thereby defining source end waveguide section **36*a*, transition waveguide section 36*b* and feed end waveguide section 36*c* which has a reduced height. All three waveguide sections 36*a*–*c* predominantly support the $TE_{10}$ propagation mode at the operating frequency of microwave oven 10. Accordingly, when the output probe 37 of magnetron 28 is excited at a microwave frequency such as, for example, 2450 megahertz, the microwave energy propagates predominantly in the $TE_{10}$ mode from source end waveguide section 36*a* through transition waveguide section 36*b* to feed end waveguide section 36*c***.

Figure 4:
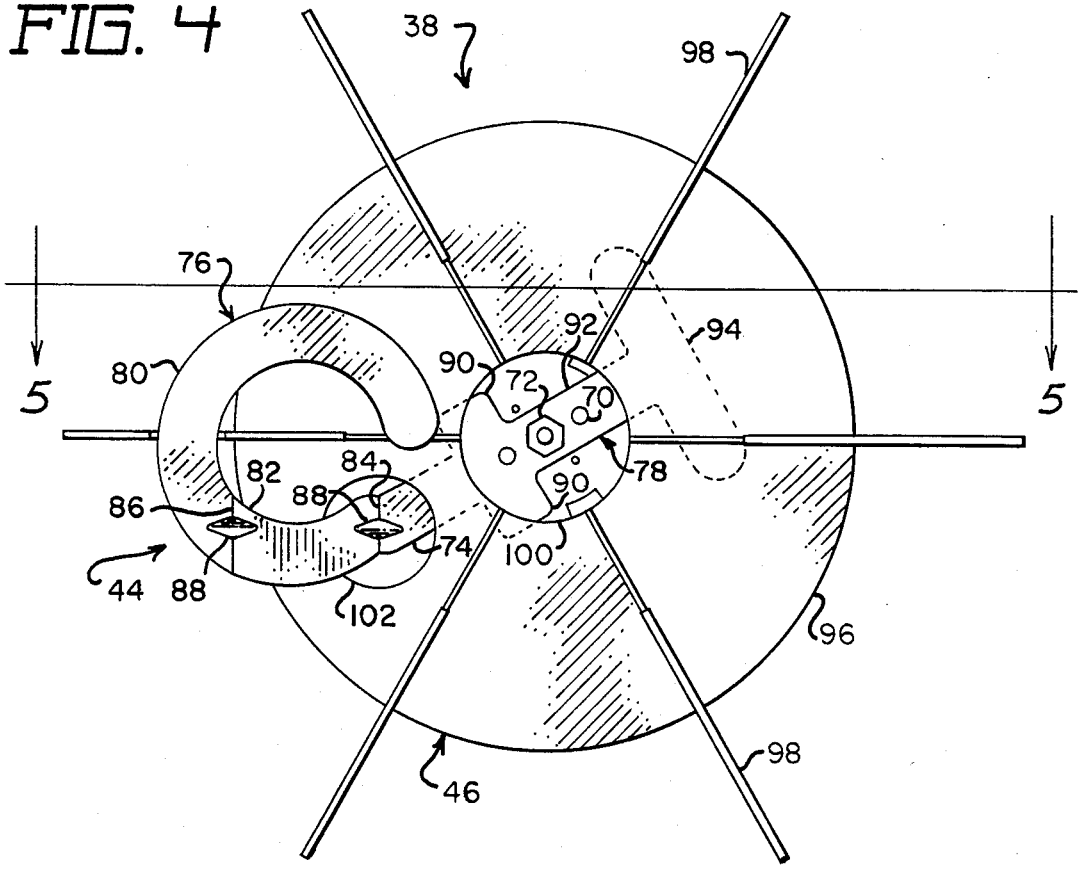
FIG. 4 is a bottom plan view of the microwave feed assembly.
Figure 5:
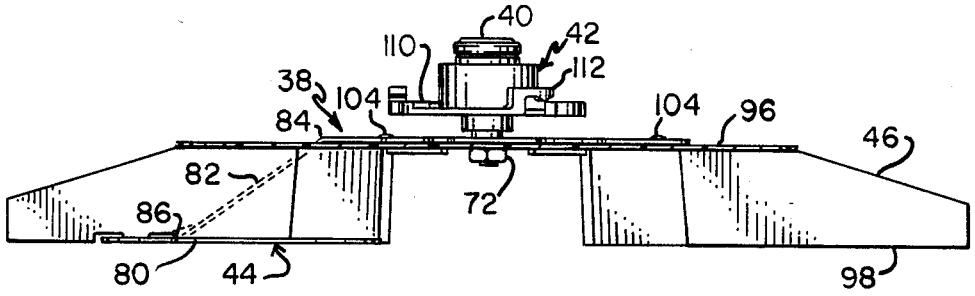
FIG. 5 is a side elevation view of the microwave feed assembly.
Figure 6:
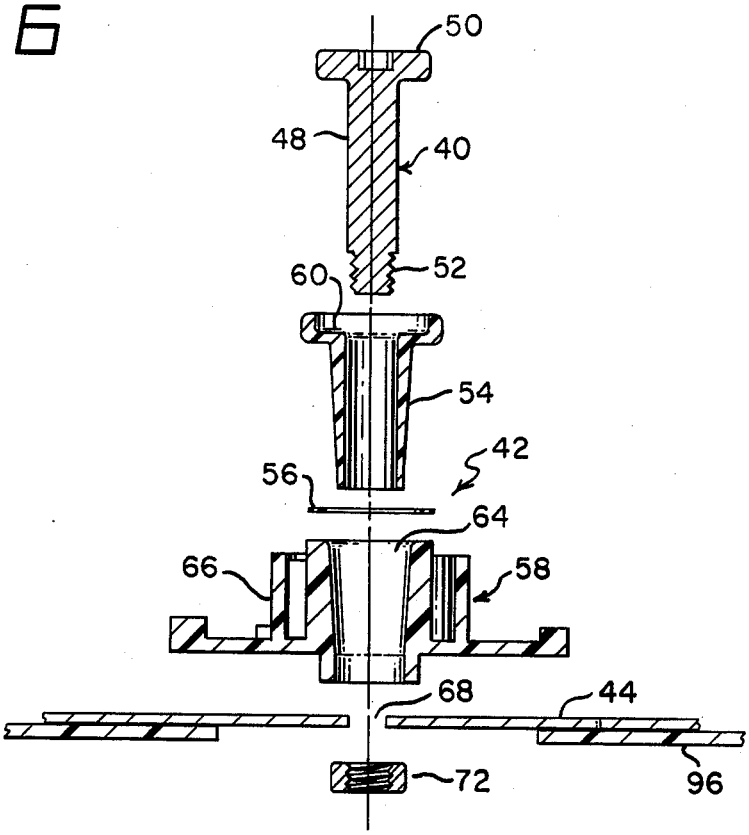
FIG. 6 is a side exploded view of the probe and mounting assembly.
Figure 7:
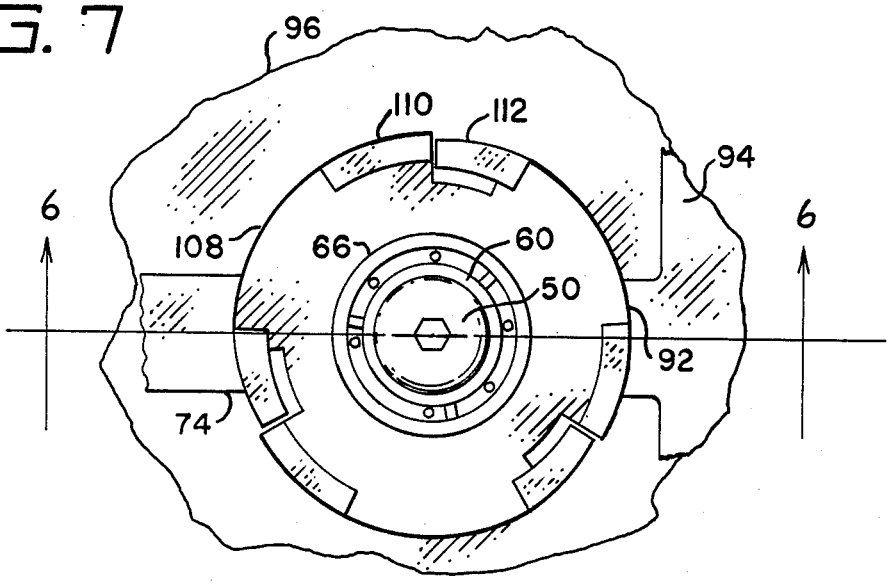
FIG. 7 is a top view of the probe and mounting assembly.
Figure 8:
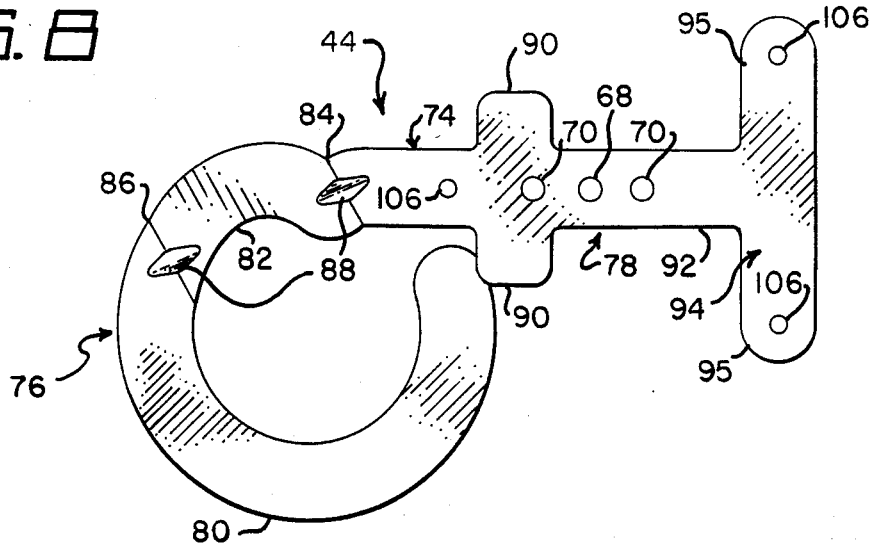
FIG. 8 is a top view of the conductive strip.
Figure 9:
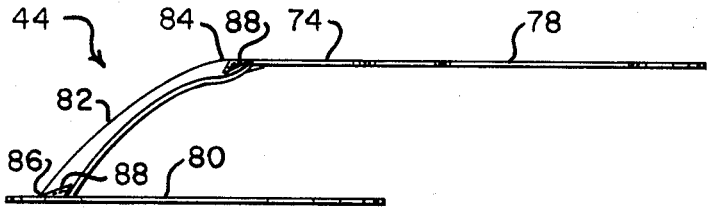
FIG. 9 is a side view of the conductive strip.
Figure 10:
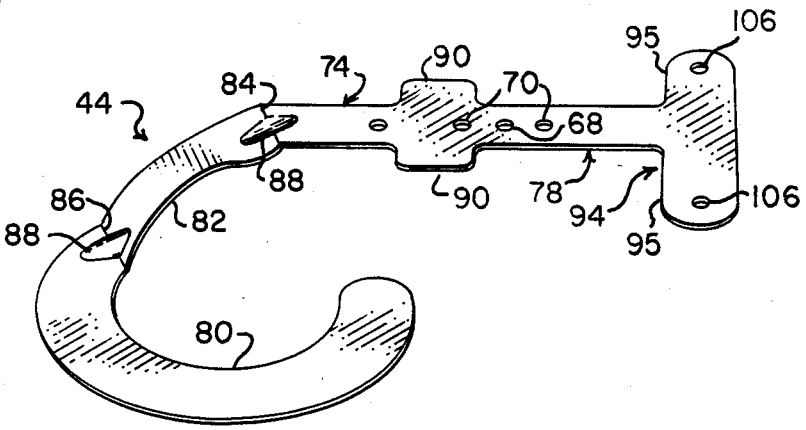
FIG. 10 is a perspective view of the conductive strip.

Referring to FIGS. 4 and 5, bottom plan and side elevation views of microwave feed assembly 38 are shown. The general function of microwave feed assembly is to couple microwave energy from feed end waveguide section **36*c* into cavity 12 and then radiate the energy in a downwardly directed pattern that moves or revolves in a horizontal circular path. As will be described later herein in accordance with the invention, the energy in the pattern is substantially circularly polarized. Microwave feed assembly 38 includes probe 40, mounting assembly 42, conductive strip 44, and turbine 46. FIGS. 6 and 7 respectively show side exploded and top views of probe 40 and mounting assembly 42. Probe 40 is a conductive rod 48 having a capacitive hat 50 at the top end and threads 52 at the bottom end. Mounting assembly 42 functions to support probe 40 in vertical alignment in aperture 53 while rotatably suspending conductive strip 44 for rotation about the axis of probe 40. Although other suitable structure could be used, mounting assembly 42 includes inner bearing 54, washer 56, and outer bearing 58 all of which are made of a dielectric material. In fabrication, probe 40 is inserted down into dielectric inner bearing 54 and capacitive hat 50 seats on lip 60. Inner bearing 54 then inserts down through washer 56 into bore 64 of central cylinder 66 of dielectric outer bearing 58. Washer 56, which supports inner bearing 54 on outer bearing 58, is made of a low friction material such as Teflon to enable probe 40 and inner bearing 54 to rotate easily about the axis of probe 40 within bore 64 of outer bearing 58. The threaded end of probe 40 is then inserted into hole 68 of conductive strip 44 and nut 72 is tightened down on threads 52 to fasten together microwave feed assembly 38. FIGS. 8, 9 and 10 respectively show top, side, and perspective views of conductive strip 44. Holes 70 on both sides of hole 68 are used by a tool which mounts microwave feed assembly 38 in aperture 53** as will be described later herein.

Referring to FIGS. 8–10, conductive strip 44 includes a helical strip antenna 76, a strip conductor 74, and a strip support 78 or strip connector. Conductive strip 44 is punched or cut from a flat sheet of aluminum alloy having a thickness of approximately 0.032 inches. Helical antenna 76 has a width of 0.5 inches as defined in its initial flat shape by an outer radius of 1.25 inches and an inner radius of 0.75 inches. In its initial flat shape, helical antenna 76 has a center line arc of approximately 320°. Then, along bend lines 84 and 86, which are spaced approximately 1.56 inches, cylindrical segment 82 is bent to have a slope of approximately 35° downwardly with the planes of strip conductor 74 and flat segment 80 being parallel. Indents 88 on bend lines 84 and 86 add structural strength. Accordingly, in its final configuration as shown in FIGS. 8–10, helical strip antenna 76 includes a horizontal or flat segment 80 having a center line arc of approximately 226° and a sloped or cylindrical segment 82 declining at approximately 35° to space flat segment 80 approximately $\frac{7}{8}$ of an inch further from flat top 34 than the input to cylindrical segment 82. Strip conductor 74 has a length of approximately 1.5 inches as measured from the microwave feed point defined by the electrical and physcial connection to probe 40 at hole 68. Two tabs 90 extend outwardly approximately 0.375 inches from opposite edges of strip conductor 74 which is approximately 0.5 inches wide. Tabs 90, which function to provide capacitive impedance match, have a length of approximately 0.5 inches and are spaced from hole 68 by approximately 0.25 inches. Strip support 78 has a width of approximately 0.5 inches and extends oppositely from strip conductor 74 to add structural support and secure the connection of conductive strip 44 to turbine 46. As will be described in more detail later herein, the plane of strip conductor 74 and strip support 78 is spaced approximately 0.3 inches or less than $\frac{1}{8}$ wavelength from flat top 34 so as to minimize microwave radiation from them. The effect of strip support 78 on the overall impedance and microwave radiating properties of conductive strip 44 is further reduced by properly selecting its dimensions so as to provide a high input impedance to it. More specifically, strip support 78 defines a one-inch strip 92 terminating in a 2.25-inch perpendicular cross member or anchor 94. In an alternate embodiment, anchor 94 may preferably be curved, in which case its length would be shorter.

Again referring to FIGS. 4 and 5, turbine 46, which is made of a dielectric material such as plastic, is connected to conductive strip 44 and functions to rotate helical antenna 76 about the axis of probe 40. Turbine 46 includes a horizontal disk 96 having vertical radial vanes 98 or paddles connected underneath. Disk 96 has a central aperture 100 through which the threaded end of probe 40 inserts for mating with nut 72. Disk 96 also has a side aperture 102 through which cylindrical segment 82 of helical antenna 76 extends. The top of disk 96 has a plurality of bosses 104 which align with holes 106 in conductive strip 44. In connecting conductive strip 44 to turbine 46, bosses 104 are inserted through holes 106 and then melted for permanent engagement.

FIG. 5 shows the final assembly of microwave feed assembly 38 before insertion into aperture 53 which communicates from feed end waveguide section **36*c* to cavity 12. Outer bearing 58 has a flange 108 with raised pads 110 and locking clips 112, as shown best in FIGS. 5 and 7. Aperture 53 in ceiling 22 is circular so it can easily be deburred to reduce the possibility of arcing; it receives cylinder 66 of outer bearing 58. Arcuate slots 111 surround aperture 53 and receive locking clips 112. Then, a manufacturing tool which inserts through holes 70 to engage outer bearing 58 is used to twist outer bearing 58 so that locking clips 112 above and raised pads 110 below clamp on portions of flat top 34 peripheral to the respective ends of arcuate slots 111. Probe 40 then vertically extends from waveguide section 36*c* to recess 30 of cavity 12** in securely but axially rotatable alignment.

In operation, the microwave energy in feed end waveguide section **36*c* excites microwave currents on probe 40 which coaxially couple the energy down conductive probe 40 through aperture 53 to the junction of conductive strip 44 at hole 68. Most of the microwave current conducts in the direction of strip conductor 74 rather than strip support 78 because, as described earlier herein, the geometry of strip support 78 is configured so as to provide a high input impedance. More specifically, the oppositely directed arms 95 of anchor 94 are joined in parallel to provide a low impedance which transforms into a high impedance at the input to strip support 78 which is spaced approximately one-quarter wavelength away. The two arms 95 of anchor 94 should not total a half wavelength because that could cause high field strength and possible arcing if oven 10 were operated without a load. As stated earlier, there is very little microwave radiation from strip conductor 74 because it is spaced approximately 0.3 inches or less than $\frac{1}{8}$ wavelength from flat top 34 of ceiling 22. More specifically, the combination of flat top 34 and strip conductor 74 functions as an air dielectric microstrip transmission line wherein flat top 34 is the metallic ground plate or ground plane. According to principles well known to those skilled in the art, the closely spaced ground plate or reflector maximizes transmission and minimizes radiation. It is also noted that strip support 78 is closely spaced to flat top 34 such that the relatively small currents traveling in that direction would also cause minimal radiation. Also as described earlier herein, tabs 90 provide impedance matching between probe 40 and helical strip antenna 76**.

The microwave current enters cylindrical segment 82 of helical strip antenna 76 from strip conductor 74 at bend line 84. The current conducts around the hook shape of helical strip antenna 76 substantially as a traveling wave. As is well known, the direction or polarization of the electric field in the radiated pattern is parallel to the current in the antenna that radiated it. Therefore, as the current conducts around the hook in a traveling wave, the electric vector in the radiated field rotates in a substantially X-Y or horizontal plane with the radiation generally traveling in the downward or Z direction. The radiated pattern of helical strip antenna 76 is dependent not only upon the magnitude and the direction of the current at each point along the hook shape, but also on the reflection from flat top 34 of ceiling 22 which functions as a ground plane. As stated earlier herein, a conductive strip near a reflector acts like an air dielectric microstrip transmission line and therefore provides little radiation. As the spacing to the reflector increases, radiation increases. Radiation is especially enhanced when the spacing is one-quarter wavelength. Accordingly, where cylindrical segment 82 is relatively closely spaced to flat top 34 as it first starts around the hook adjacent to bend line 84, radiation is limited even though the magnitude of the current is maximum. As the wave conducts around the hook of cylindrical segment 82 in its approximately 35° downward slope, the current magnitude decreases because of radiation energy losses but the radiative efficiency increases because the distance to flat top 34 increases. Viewed differently, as the efficiency increases, the current magnitude decreases. In accordance with the invention, the increase in radiative efficiency caused by the increase in spacing from flat top 34 compensates for the decrease in relative magnitude of the traveling current wave around the hook such that the electric fields in the X and Y direction have comparable magnitudes with a 90° phase difference. Accordingly, substantially circular polarization is provided. Summarizing, as the current progresses around the hook, there is an increase in radiative efficiency, a reduction in current available, a change in phase, and a change in the direction of the current. In accordance with the invention, these conditions are properly balanced such that the radiated field has substantial circular polarization.

It was found that if helical strip antenna were completely in a horizontal plane instead of having the slope of cylindrical segment 82, the radiation from the region closest to the feed point would be substantially greater than radiation further around the hook. Accordingly, the radiated electric vectors in the X and Y direction would have substantially different magnitudes and the polarization would therefore be strongly eliptical or linear rather than circular. Constraints in the geometry of cavity 12 made it desirable that flat segment 80 be in a horizontal plane and not continue the downward slope of cylindrical segment 82. Making flat segment 80 horizontal and therefore parallel to flat top 34 does not dramatically alter the relative magnitude between the X and Y electric vectors because, as the spacing approaches a quarter wavelength, the increase in radiative efficiency becomes insignificant anyway. The electromagnetic field radiated from helical strip antenna 76 is determined by the radiation from the entire length of the antenna and it has been found to be substantially circularly polarized over a relatively large angle of radiation. This does not mean, however, that it is pure circular polarization because the polarization in some of the field is only partially circular and at some angles it is even linear. Specifically, in measurements made with a rotating linearly polarized receiving antenna, the radiated pattern of the described embodiment was found to be better than 50% circularly polarized; that is, the weak axis linearly polarized component was at least 50% of the strong axis linearly polarized component over an angle of 80° in a plane perpendicular to strip conductor 74 and over an angle of 50° in a plane parallel to strip conductor 74. At about one-half these angles, the radiation was 70% circular. The measurements included the residual radiation from strip conductor 74 and strip support 78 which contributed a linearly polarized component parallel to strip conductor 74.

As is well known, a circularly polarized wave is equivalent to or can be expressed as two independent orthogonal linear waves which are shifted in phase by 90°. Generally, the two orthogonal linear waves reflect off an arbitrary object or surface with different phase shifts or different effective reflecting planes. Accordingly, as compared to a linear wave, a circularly polarized wave can be considered as having an additional wave or parameter which thereby increases the randomness of the total electromagnetic field distribution in the cavity. It follows that spatial maxima and minima in the distribution of energy caused by interference of complex standing waves are reduced as compared with linear polarized waves. The net result is that circular polarization provides more uniform heating than linear polarization. The uniformity of the energy distribution and hence cooking profile within cavity 12 is further improved by rotating or revolving helical strip antenna 76 and hence its radiated pattern about the axis of probe 40. Suitable apparatus such as a motor could be used to rotate probe 40. In the preferred embodiment and with reference to FIGS. 2 and 3, a flow of air is directed against vanes 98 of turbine 46 to provide the rotational torque. More specifically, air which is conventionally forced by a blower (not shown) across magnetron 28 for cooling is then routed into chamber 114 above ceiling 22. The air then flows down through perforations 116 in ceiling 22 and appropriately positioned partitions 118 in grease shield 120 cause the air to swirl past turbine 46. For a more complete description of the air flow, see U.S. Pat. No. 4,335,289, issued June 15, 1982, which is hereby incorporated by reference. The force of the air on vanes 98 causes turbine 46 to rotate about the axis of probe 40. Accordingly, helical strip antenna 76 and its circularly polarized radiative pattern move in a substantially circular horizontal path. In addition to moving in a circular path, helical strip antenna 76 and hence its radiated circularly polarized pattern rotate about its own axis.

In an alternate embodiment, a plurality of helical strip antennas 76 with corresponding strip conductors 74 could be radially offset from the axis of probe 40. Accordingly, a plurality of circularly polarized radiation patterns would combine into a single pattern which would have a different and perhaps advantageous time-averaged radial distribution than the pattern of helical strip antenna 76. It would be preferable to rotate the plurality of antennas about the axis of probe 40.

This concludes the Description of the Preferred Embodiment. A reading of it by those skilled in the art will bring to mind many alterations and modifications without departing from the spirit and scope of the invention. Accordingly, it is intended that the scope of the invention be limited only by the appended claims.

What is claimed is:

1. A microwave oven, comprising:

an oven cavity having a flat conductive surface;

a helical antenna positioned in said cavity, said helical antenna comprising a first segment oblique to said flat conductive surface, said first segment having a feed end spaced less than one-eighth wavelength from said flat conductive surface and a second end spaced more than one-eighth wavelength from said surface;

said helical antenna further comprising a second segment connected to said second end of said first segment, said second segment being parallel with said flat conductive surface;

a source of microwave energy coupled to said feed end of said first segment; and said helical antenna radiating microwave energy having substantially circular polarization.

2. The oven recited in claim 1 further comprising means for moving said helical antenna in a circular path parallel with said flat conductive surface.

3. The oven recited in claim 1 further comprising a waveguide positioned outside said cavity, a probe for coupling microwave energy from said waveguide into said cavity, and a strip transmission line perpendicularly connected to said probe and parallelly spaced less than one-eighth wavelength from said flat conductive surface.

4. The oven recited in claim 3 further comprising means for rotating said probe about its axis.

5. A microwave oven, comprising:

an oven cavity having a conductive ceiling comprising a horizontal surface;

a helical strip antenna positioned in said cavity, said antenna having a cylindrical segment with a feed end spaced less than one-eighth wavelength from said surface of said ceiling and a second end spaced greater than one-eighth wavelength from said surface of said ceiling wherein said cylindrical segment is oblique to said surface, said antenna further comprising a flat segment connected to said second end of said cylindrical segment, said flat segment being parallel with said surface; and a source of microwave energy coupled to said feed end of said cylindrical segment for producing a traveling wave of microwave current on said antenna wherein said antenna radiates microwave energy having substantially circular polarization.

6. The oven recited in claim 5 further comprising means for moving said helical strip antenna in a horizontal circular path.

7. The oven recited in claim 6 further comprising a waveguide positioned outside said cavity, a probe for coupling microwave energy from said waveguide into said cavity, and a strip transmission line perpendicularly connected to said probe and parallelly spaced less than one-eighth wavelength from said surface.

8. The oven recited in claim 7 wherein said moving means comprises means for rotating said probe about its axis.

9. A microwave oven, comprising:

a microwave cavity;

a radiator of substantially circularly polarized microwave radiation, said radiator being positioned in said cavity, said radiator being an antenna comprising a cylindrical segment sloping from a feed end away from a wall of said cavity and a flat segment parallel with said wall connected to the opposite end of said cylindrical segment;

a source of microwave energy coupled to said radiator; and means for moving said radiator in a circular path within said cavity.

10. A microwave oven, comprising:

an oven cavity having a ceiling comprising a flat horizontal surface;

a helical strip antenna positioned adjacent to said horizontal surface for providing a ground plane for said helical strip antenna, said helical strip antenna having at least a segment oblique to said horizontal surface sloping downward from a feed end spaced less than one-eighth wavelength from said horizontal surface;

means for energizing said helical strip antenna to radiate microwave energy having substantially circular polarization; and means for moving said helical strip antenna in a circular horizontal path.

11. The oven recited in claim 10 wherein said feed end is spaced approximately 0.3 inches from said horizontal surface.

12. The oven recited in claim 10 wherein said helical strip antenna further comprises a second segment parallel to said horizontal surface and connected to the end of said oblique segment opposite said feed end.

13. The oven recited in claim 12 wherein said energizing means comprises a waveguide outside said cavity, a probe for coupling microwave energy from said waveguide into said cavity, and a strip transmission line perpendicularly connected to said probe and parallelly spaced less than one-eighth wavelength from said horizontal surface of said ceiling.

14. A microwave oven, comprising:

a microwave cavity having sides, a ceiling comprising a flat horizontal surface, and a floor;

a waveguide positioned above said ceiling;

means for exciting said waveguide with microwave energy;

an aperture in said waveguide communicating into said cavity;

a vertical probe positioned in said aperture for coupling said microwave energy from said waveguide into said cavity;

a horizontal strip conductor connected to said probe in said cavity for conducting said microwave energy, said conductor being spaced less than one-eighth wavelength from said flat horizontal surface of said ceiling whereby said surface functions as a ground plate of a microstrip transmission line to suppress radiation from said strip conductor;

a helical strip antenna connected to one end of said strip conductor for radiating said microwave energy in said cavity with substantially circular polarization, said helical strip antenna having a flat segment spaced more than one-eighth wavelength from said horizontal surface of said ceiling and a sloped cylindrical segment interconnecting said strip conductor and said flat segment; and means for rotating said helical strip antenna about the axis of said probe.

15. The oven recited in claim 14 wherein said strip conductor is spaced approximately 0.3 inches from said flat horizontal surface of said ceiling.

16. The oven recited in claim 14 wherein said cylindrical segment defines an approximately 90° arc having a vertical drop of approximately seven-eighths of an inch.

17. A microwave oven, comprising:

a microwave cavity having sides, a floor, and a ceiling comprising a domed recess having a flat top;

a waveguide positioned above said ceiling;

means for exciting said waveguide with microwave energy;

an aperture in said flat top communicating from said waveguide to said recess;

a vertical probe extending from said waveguide through said aperture into said recess for coupling said microwave energy;

a horizontal strip conductor perpendicularly connected to said probe in said recess for conducting said microwave energy, said conductor being spaced less than one-eighth wavelength of said microwave energy from said flat top wherein said flat top functions as a ground plate of an air dielectric microstrip transmission line thereby limiting radiation from said strip conductor;

a helical strip antenna haing at least a portion located within said recess, said antenna having a horizontal flat segment spaced greater than one-eighth wavelength from said flat top and a cylindrical segment oblique to said flat top interconnecting said strip conductor and said flat segment, said antenna radiating microwave energy have substantially circular polarization over a large angle; and an air driven dielectric turbine connected to said antenna for rotating said helical strip antenna about the axis of said vertical probe.

18. The oven recited in claim 17 wherein said strip conductor and said helical strip antenna are fabricated from an aluminum strip having an approximately 0.5-inch width and an approximately 0.032-inch thickness.

19. The oven recited in claim 17 further comprising a strip connector extending in the opposite direction of said strip conductor past said probe to a perpendicularly attached strip used to secure said strip conductor to said turbine.

20. The oven recited in claim 17 further comprising a pair of horizontal oppositely directed strip tabs connected to said strip conductor between said probe and said helical strip antenna for providing capacitance to match said helical strip antenna to said probe.

* * * * *